US005636623A

United States Patent [19]

Panz et al.

[11] Patent Number: 5,636,623

[45] Date of Patent: Jun. 10, 1997

[54] METHOD AND APPARATUS FOR MINIMIZING TURBULENCE IN A SUBMERGED COMBUSTION SYSTEM

[75] Inventors: Eric Panz, West Vancouver; Steven E. Panz, North Vancouver, both of Canada

[73] Assignee: Inproheat Industries Ltd., Vancouver, Canada

[21] Appl. No.: 215,599

[22] Filed: Mar. 22, 1994

[51] Int. Cl.[6] ..... F24H 1/20

[52] U.S. Cl. ..... 126/360 A; 126/360 R; 126/366; 122/31.2

[58] Field of Search ..... 126/360 R, 360 A, 126/366, 367, 368; 431/328, 157, 160; 122/509, 368, 31.2

[56] References Cited

U.S. PATENT DOCUMENTS

| | | | |
|---|---|---|---|
| 3,209,745 | 10/1965 | Glaser et al. | 126/360 A X |
| 3,368,548 | 2/1968 | Santoleri et al. | 126/360 A |
| 4,141,343 | 2/1979 | Awano et al. | 126/360 A |
| 5,032,230 | 7/1991 | Shepherd | 126/360 A X |

FOREIGN PATENT DOCUMENTS

| | | | |
|---|---|---|---|
| 0014143 | 1/1982 | Japan | 126/360 A |
| 0282451 | 11/1988 | Japan | 126/360 A |
| 0623057 | 9/1978 | U.S.S.R. | 126/360 A |

*Primary Examiner*—Carl D. Price

*Attorney, Agent, or Firm*—Oyen Wiggs Green & Mutala

[57] ABSTRACT

This invention relates to a novel submerged combustion system. More particularly, this invention relates to a method and apparatus for minimizing turbulence in a submerged combustion system. The submerged combustion system can be installed singly or in combination with other similar submerged combustion systems to heat large quantities of liquids and solutions. The invention is directed to a submerged combustion system wherein hot products of combustion are forced through a solution to heat the solution, the hot combustion products being created by burning a fuel with air in the interior of a retaining means, and the hot gaseous products of combustion being exhausted from the interior of the retaining means into the solution, the improvement comprising exhausting the hot gaseous products of combustion through a first port at a predetermined elevation below the level of the solution, the size of the port being predetermined to minimize foam being created at the surface of the solution.

2 Claims, 10 Drawing Sheets

4
34
56
58
60

51
62
68
64
68
50
50

50
62
64
67
68
68
64
62
51
50

50
62
64
68
67
64
62
50

METHOD AND APPARATUS FOR MINIMIZING TURBULENCE IN A SUBMERGED COMBUSTION SYSTEM

FIELD OF THE INVENTION

This invention relates to a novel submerged combustion system. More particularly, this invention relates to a novel submerged combustion system which can be installed singly or in combination with other similar submerged combustion systems to heat large quantities of liquids and solutions.

BACKGROUND OF THE INVENTION

Submerged combustion is a method of heating whereby hot products of combustion are forced through a solution to heat the solution. The heat exchange occurs directly between the hot products of combustion and the solution. In a submerged combustion system, the hot combustion products are generated by a flame which is typically fed by a combination of air and natural gas. The flame does not come into contact with the solution. This technology differs from conventional heat exchange methods such as immersion tube heating where the heat exchange is indirect and the products of combustion are exhausted directly to the atmosphere, rather than being forced through the solution. Submerged combustion can be utilized to heat liquids with overall system efficiency greater than 90%. Conventional hot water boiler heating systems have an efficiency of about 80% while immersion tube systems have an efficieny of about 70%.

In applications where separation of components by distillation or absorption is required, submerged combustion can be applied to provide liquid temperatures up to about 195° F.

In addition to high efficiency, submerged combustion systems are advantageous because they maintain a uniform temperature throughout the solution in which the submerged combustion is conducted. The hot combustion products keep the solution in constant agitation. Submerged combustion systems are also suitable for heating contaminated liquids. Expenses are usually lower because the submerged combustion can be conducted in a tank which need not be pressurized. Unlike boiler heating applications, a certified operating engineer is not required to operate a submerged combustion system.

Typical industrial applications for submerged combustion systems include: (a) natural gas processing plants—effluent pond heating; (b) municipal effluent holding and treatment ponds—maintenance of pond temperatures to ensure continuous high level of biological degradation especially in regions that experience extreme seasonal temperature changes; (c) aggregate wash plants—heating aggregate wash water at concrete batch plants; (d) log ponds and conditioning chests—heating log ponds and conditioning vats in plywood, veneer, orientated strand board (OSB), waferboard, chopstick plants; (e) pulp and paper—mill water intake protection against freezing, white water solution heating; (f) heap leach mining heating of barren solutions for ore extraction in heap leaching operations; (g) wet potash mining—heating of barren brine solution to maximize solubility and recovery of potash in flooded potash mines; (h) coal thawing for conveying; (i) carpet and fabric manufacturing—heating of bulk carpet and fabric dyes; (j) cogeneration—evaporation of waste water to recover water treatment chemicals in plants with zero effluent discharge; and (k) industrial processes—processes requiring large volumes of hot water or non-flammable liquids, or processes requiring a direct source of heat for distillation or absorption.

Typical commercial applications for submerged combustion systems include: (a) swimming pool heating—institutional and residential; (b) fish hatcheries—fresh water heating; (c) commercial laundries—wash water heating; (d) automotive car washes; (e) snow disposal; and (f) food processing plants.

SUMMARY OF THE INVENTION

The invention is directed to a submerged combustion system wherein hot products of combustion are forced through a solution to heat the solution, the hot combustion products being created by burning a fuel with air in the interior of a retaining means, and the hot gaseous products of combustion being exhausted from the interior of the retaining means into the solution, the improvement comprising exhausting the hot gaseous products of combustion through a first port at a predetermined elevation below the level of the solution, the size of the port being predetermined to minimize foam being created at the surface of the solution.

In this method, the retaining means can have a second port which is at an elevation which is lower than the first port. The retaining means can also have a third port which is at an elevation which is lower than the first and second ports.

In the method as described, there can be a plurality of first ports, a plurality of second ports, and a plurality of third ports, the plurality of first ports each being at a first elevation, the plurality of second ports each being at a second elevation lower than the first elevation, and the plurality of third ports each being at a third elevation lower than the elevation of the second ports and the elevation of the first ports.

The invention includes a submerged combustion system for heating solution comprising: (a) a vessel for holding the solution, the vessel having a solution inlet and a solution outlet, and a hot combustion gas outlet; (b) a combustion chamber within the vessel and positioned so that at least part of the combustion chamber is submerged in solution when the vessel holds solution, the combustion chamber having a burner which mixes and burns fuel and air to generate hot combustion gases which are expelled from the interior of the combustion chamber through the solution; (c) at least one first combustion gas exhausting port located in the base region of the combustion chamber at a first elevation; and (d) at least one second combustion gas exhausting port located in the base region of the combustion chamber at a second elevation different from the first elevation.

The combustion system can have a plurality of first ports at a first elevation and a plurality of second ports at a second elevation. The invention can also include at least one third combustion gas exhausting port located in the base region of the combustion chamber at a third elevation different from the first and second elevations. The combustion system can have a .plurality of first ports at a first elevation, a plurality of second ports at a second elevation and a plurality of third ports at a third elevation. The combustion chamber can be a vertical cylinder. The base of the combustion chamber can be in the shape of an inverted cone.

DRAWINGS

In drawings which illustrate specific embodiments of the invention but which should not be construed as limiting or restricting the spirit or scope of the invention in any way:

DETAILED DESCRIPTION OF SPECIFIC EMBODIMENTS OF THE INVENTION

Figure 1:
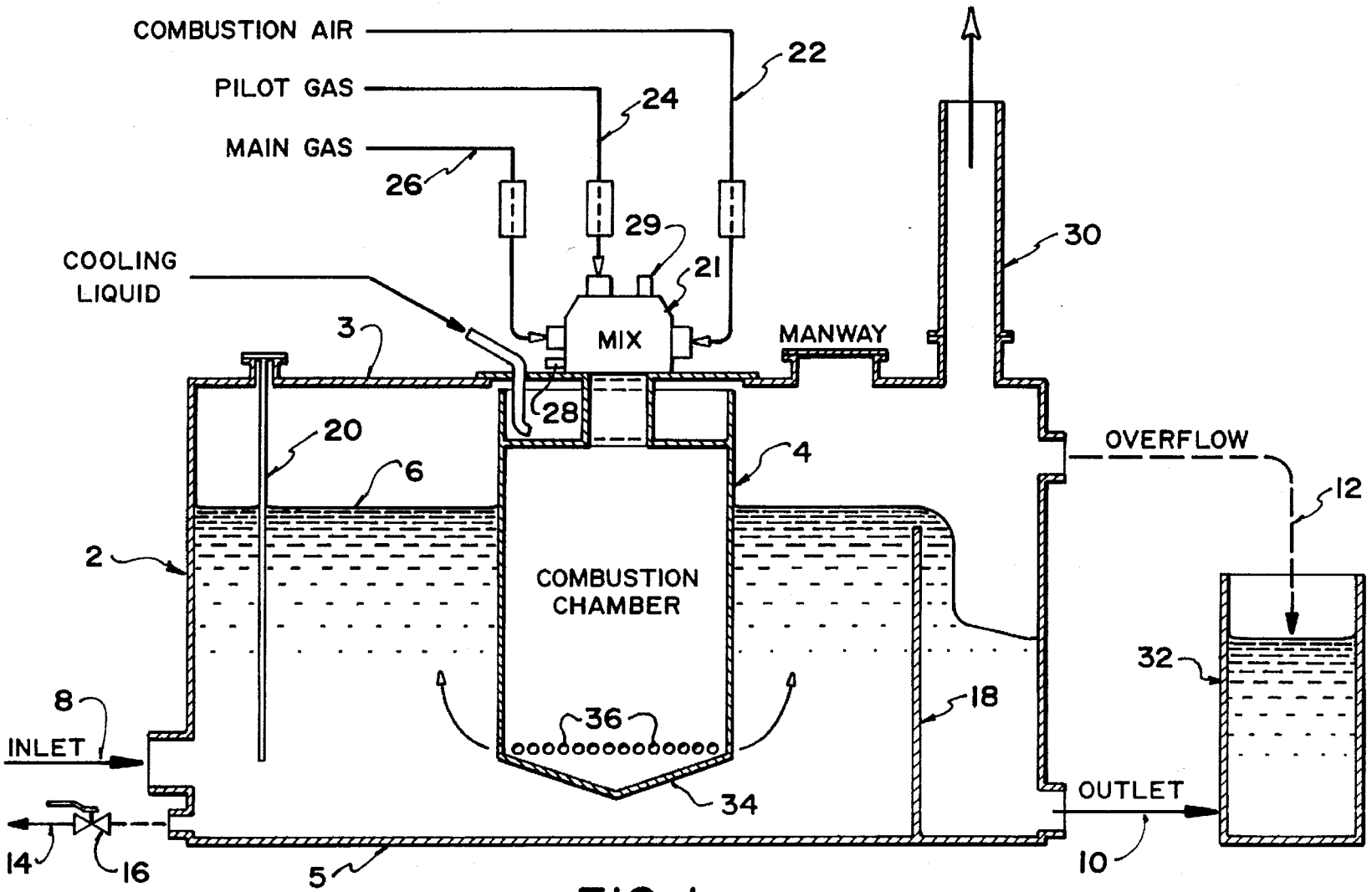
FIG. 1 illustrates a schematic side view of a submerged combustion system.

Referring to FIG. 1, which illustrates a schematic side partial section view of a submerged combustion system, the system comprises a liquid holding tank 2 which has a flat top 3 and flat bottom 5. In most cases, the tank 2 has a basic cylindrical construction. Extending downwardly in the central area of the tank 2 through an opening in the top plate 3 is a narrow cylindrical hollow combustion chamber 4. The combustion chamber 4 can be removed for maintenance. The construction of this combustion chamber 4 will be discussed in detail below.

The liquid level in the liquid holding tank 2 is depicted by liquid line 6. Liquid to be heated by submerged combustion is introduced through process inlet 8, as indicated by the arrow, and exits from the interior of the liquid holding tank 2 via process outlet 10, as also indicated by an arrow. One side of the tank 2 is fitted with a process overflow outlet 12, which coincides with the maximum upper limit tolerance level of the liquid level 6. A tank drain 14 with a valve 16 is located in the lower region of one wall of the tank 2 and permits the contents of the tank to be drained from time to time.

A liquid level control weir 18 is constructed on one side of the interior of the tank 2 and encloses the process outlet 10. The top level of the weir 18 is located below the bottom of the process overflow outlet 12, and is also usually below the liquid level 6. The overflow outlet 12 is used for emergencies. A bubble tube type liquid level sensor 20 extends downwardly from the top 3 of the tank 2 into the interior of the liquid holding tank 2 and below the liquid level. If the sensor 20 detects a predetermined unacceptable liquid level change, it will initiate burner shut-down.

Combustion air is delivered to the nozzle mix burner 21 at the top of the combustion chamber 4 by means of combustion air inlet line 22, which has a control valve. The air is delivered under pressure. Main natural gas for the nozzle mix burner 21 is delivered under pressure by a main natural gas line 24. As a general rule, 10 to 12 volumes of air are introduced per 1 volume of natural gas, in order to obtain complete and efficient combustion. A separate pilot gas line 26 is also connected to the nozzle mix burner 21. The pilot gas is used to establish a "minimum main flame". A spark type ignitor 28 extends into the interior of the nozzle mix burner 21 and is used to ignite the pilot gas flame. An electronic flame scanner or flame rod 29 detects the presence of the minimum and also a main flame. After the minimum main flame is detected by the scanner 29, the combustion air delivered through line 22 and main natural gas delivered through line 24, are mixed and injected through the nozzle burner 21, to thereby produce a large vertical "main flame" which burns in the interior of the combustion chamber 4.

Hot gaseous combustion products for heating the liquid are created by burning the combustion air and main natural gas in the interior of the combustion chamber 4. These hot gaseous products of combustion are expelled from the interior of the combustion chamber 4 through ports 36 located in the bottom region of the combustion chamber 4, and are expelled horizontally through the liquid 6. After discharge through the ports 36, the hot products of combustion are in the form of a multitude of very hot gas bubbles (approximately 3000° F.) with very low density. These bubbles in total have a vast surface area. The bubbles rapidly shrink under the hydrostatic head of the liquid 6 and due to cooling as they rise in the liquid, and energy is exchanged into the liquid 6 to thereby heat the liquid while at the same time cooling the bubbles. After the hot gaseous products of combustion have passed upwardly through the liquid 6, as a dispersion of tiny bubbles, they are exhausted from the interior of the tank 2 through exhaust outlet 30 at the top of the tank 2, as indicated by the arrow. When operating efficiently, all of the surplus heat in the gases will have been extracted and the temperature of the exhaust gas 30 will be about the same as the temperature of the outlet solution 10. Heated process fluid is discharged into a liquid seal tank 32 to prevent hot gases exiting to atmosphere except through the exhaust 30.

Figure 2:
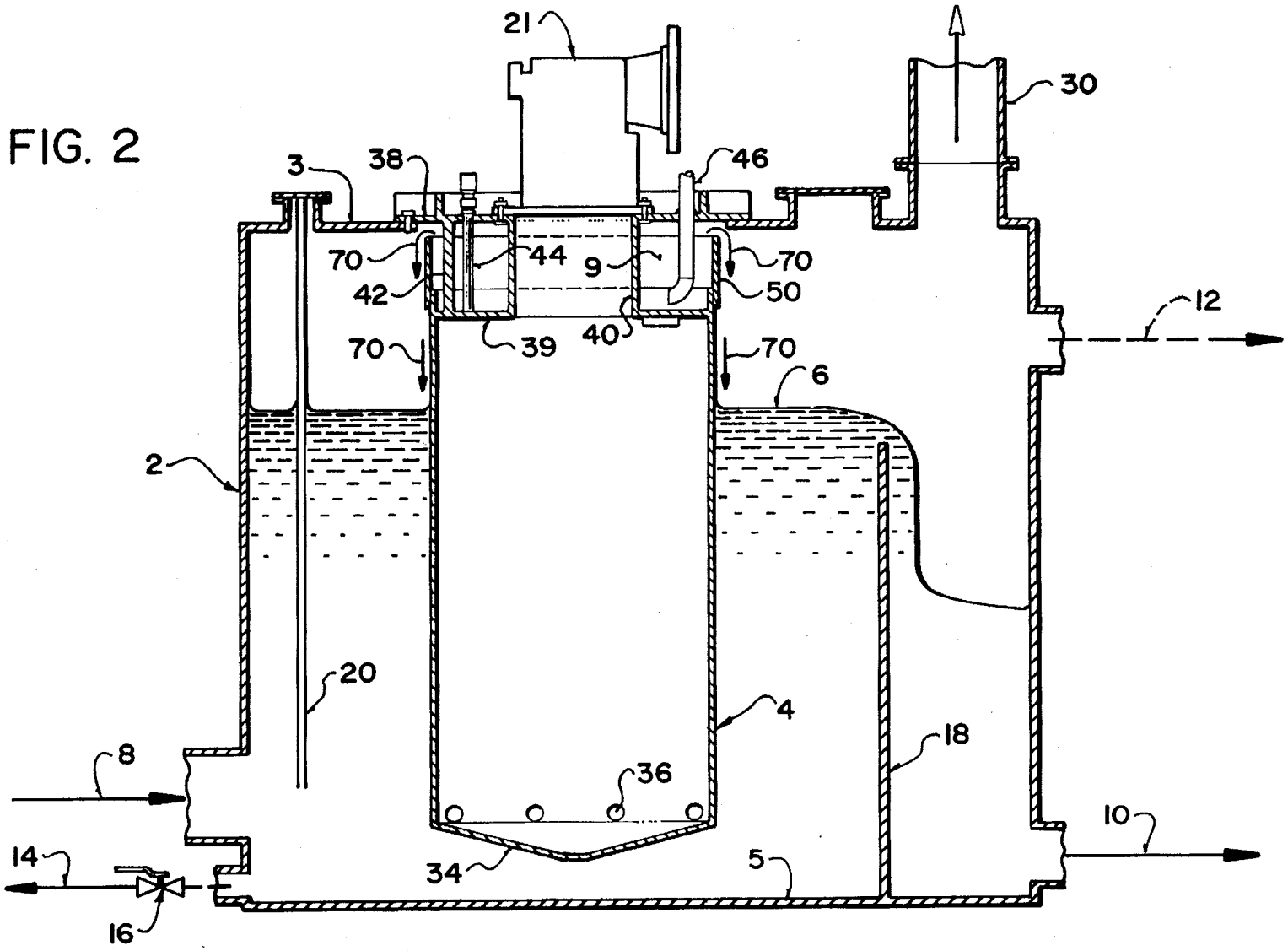
FIG. 2 illustrates an elevation section view of a submerged combustion system tank with a submerged combustion chamber installed in the interior thereof.

FIG. 2 illustrates an elevation section view of a submerged combustion system tank 2 with a partially submerged combustion chamber 4 in the interior thereof. The dimensions of the tank 2 and the dimensions of the combustion chamber 4 are sized so that maximum solution heating efficiency is obtained. The diameter of the tank 2 is approximately 3.5 times the diameter of the combustion chamber 4. We have found that this ratio minimizes metal requirements while at the same time maximizing heat transfer, liquid heating, and hot liquid circulation. There are no liquid "dead spots". FIG. 2 illustrates a number of circular ports 36 at the bottom of the sides of the chamber 4. These ports 36 dispell the hot combustion products into the liquid in the form of tiny bubbles. The burner nozzle housing 21 is positioned at the top of the combustion chamber 4, and connects with sleeve 40. The lower end of liquid level sensor 20 is submerged in the liquid 6 as indicated by dotted liquid level line 6. FIG. 2 illustrates some of the detail of the construction of the top and bottom of the combustion chamber 4. These details will be discussed more fully below. In FIG. 2, the cooling water which flows down the upper outer walls of chamber 4 on all sides is indicated by arrows 70.

Figure 3:
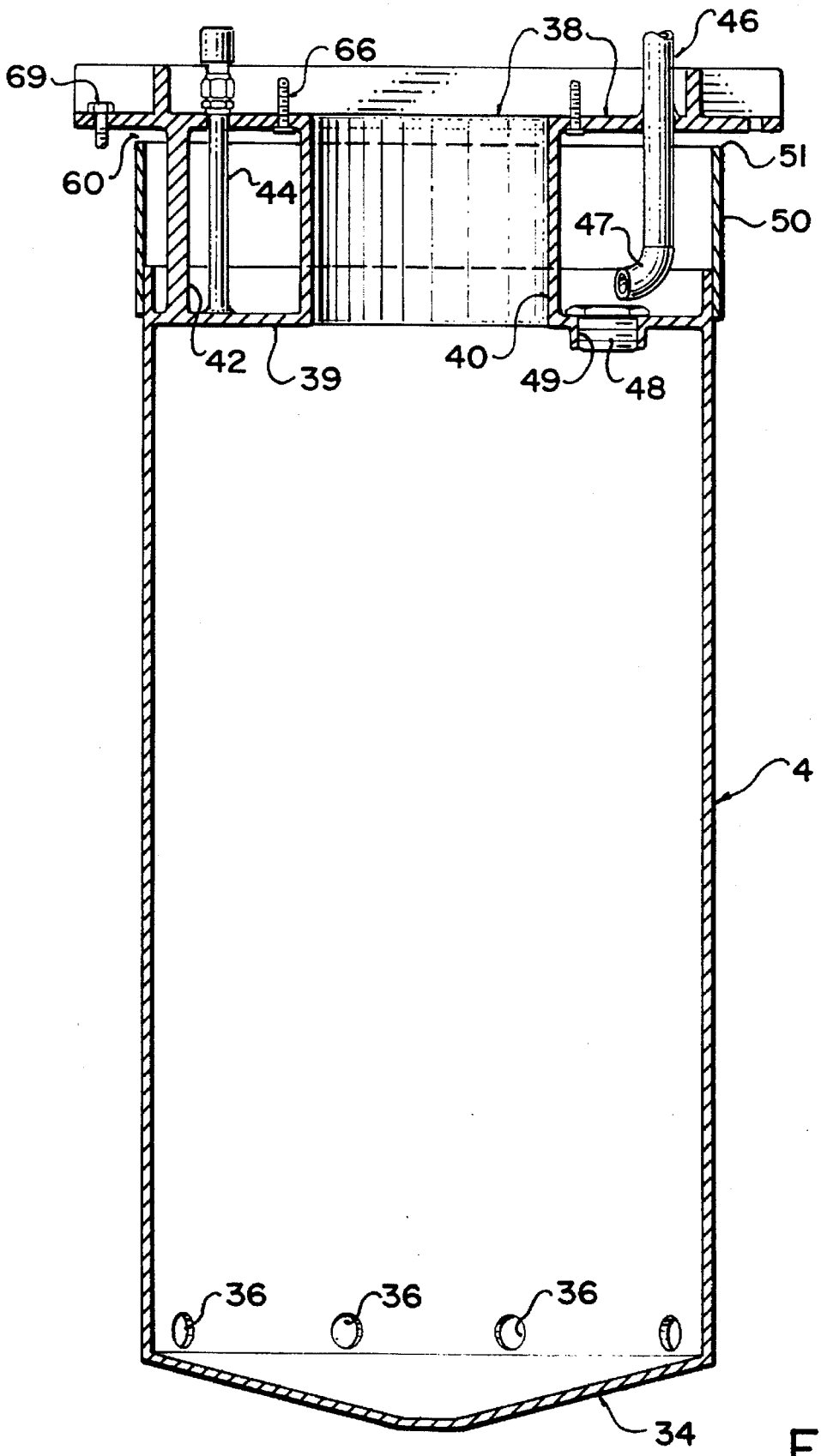
FIG. 3 illustrates an enlarged elevation section view of a combustion chamber.

FIG. 3 illustrates a side section view of a combustion chamber 4 which is depicted in general in FIG. 1 as combustion chamber 4. As shown, the height of the combustion chamber 4 is approximately three times its horizontal diameter. These dimensions coordinate with the dimensions of the tank 2 (not shown) and permit rapid gas-air mixing and an efficient combustion flame (not shown) to emit downwardly from the top of the chamber 4 without touching the interior walls of the chamber 4 or the liquid. It is important that the flame does not touch the cold walls or the liquid during operation because this reduces efficiency, leads to corrosion problems, and could "cold shock" extinguish the flame. Typically, the flame will be at about 3000° F. while the solution being heated will be between about 70° F. to about 160° F. The combustion chamber 4 is constructed in the shape of a hollow cylinder and has an inverted conical plate 34 welded or bolted to the bottom of the chamber. A series of gas combustion products exit ports 36 are formed around the circumference of the base of the combustion chamber 4, and will be discussed in greater detail below.

The top portion of the combustion chamber has a flat top plate 38 welded to the burner sleeve 40, which in turn is welded to the roof 39 of the combustion chamber 4. The periphery of the roof 39 is welded to the interior of the cylindrical side walls of the combustion chamber 4.

The volume space defined by the top plate 38, the exterior of the cylindrical burner sleeve 40 and the roof 39 is enclosed by a cylindrical adjustable elevation girdle 50 which is fitted to the exterior of the top end of the exterior walls of the combustion chamber 4. The girdle 50 in combination with the top plate 38, roof 39 and sleeve 40 define a "doughnut-like" hollow space, through which the cooling water is circulated.

The top plate 38 and the roof 39 of the combustion chamber 4 have a series of vertical support rods 42 welded to the underside of top plate 38 and the top of roof 39 of the combustion chamber 4, to prevent the development of adverse bending moments, which might be created by the long combustion chamber and bubble eruptions through the ports 36. A thermo-couple assembly 44 with the thermo-couple making contact with the roof 39 of combustion chamber 4 senses temperature and provides protection against overheating. A pipe and elbow unit 46 is constructed in the interior of the "doughnut", and serves to introduce cooling fluid in a tangential direction within the hollow interior of the "doughnut". This cooling fluid, by means of tangential introduction, swirls in a vortex pattern around the interior of the "doughnut" and spills over the top lip 51 of the girdle 50 and down the outsides of the combustion chamber 4 and ultimately into the liquid 6 confined in the interior of the tank 2 (see FIG. 1).

When the system is in a dynamic state, the level of the liquid 6 extends part way up the exterior walls of the chamber 4. The exposed walls above the liquid 6 must be cooled so that extreme temperature differences are avoided. If there were no cooling water spilling over the outsides of the upper walls, the internal flame at 3000° F. would heat the exposed walls of the chamber 4 above the liquid 6 to destructive melt temperatures, while the bottom submerged portion of the walls would remain at the temperature of the liquid which is typically about 70° F. to 160° F.

Figure 4:
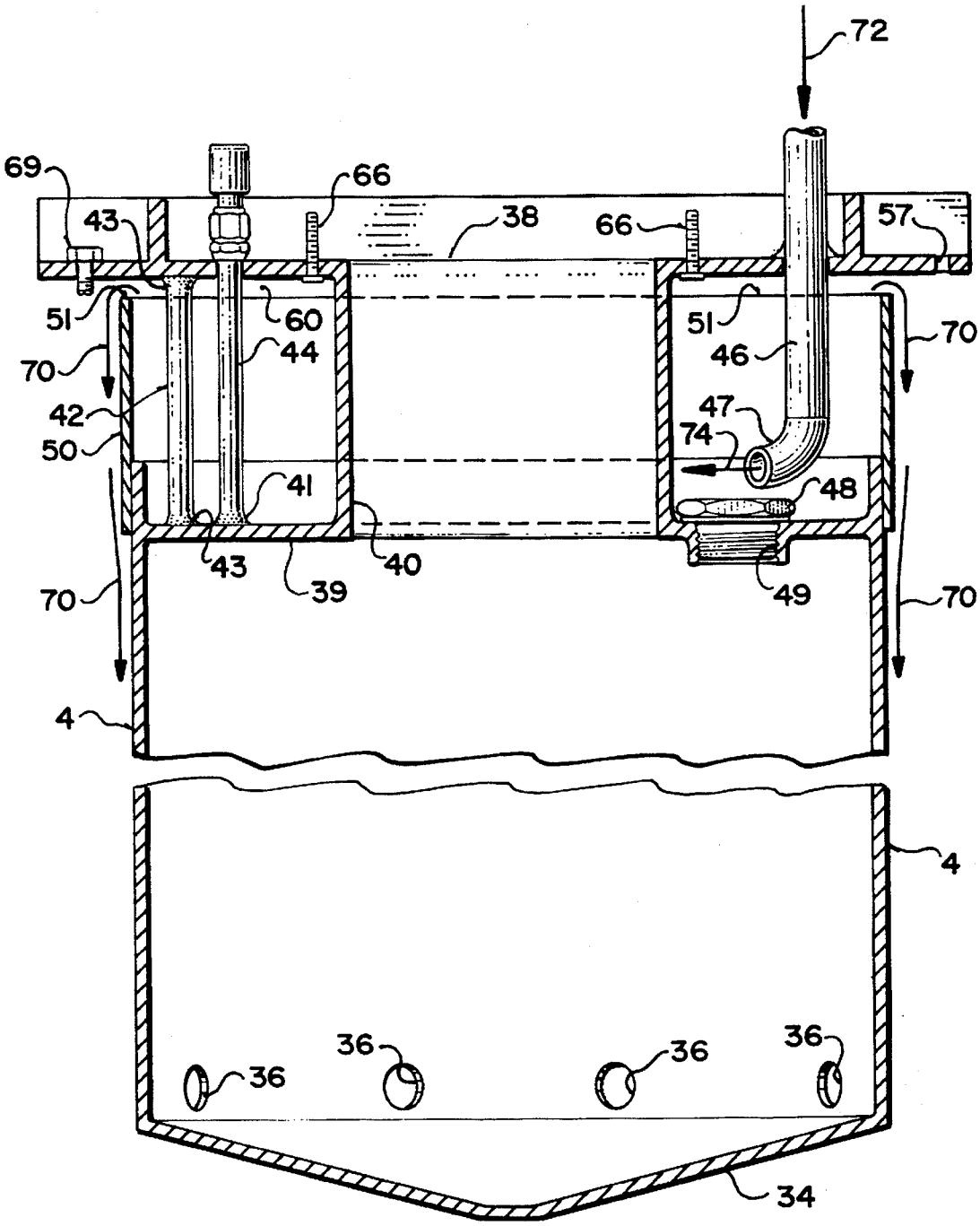
FIG. 4 illustrates a truncated elevation section view of the top and bottom parts of a combustion chamber.

FIG. 4 illustrates a truncated section view of the bottom and top portions of a combustion chamber 4. The inverted conical shape of the bottom 34 is a unique feature of the submerged combustion system. It is constructed so that steam bubbles which collect on the bottom of the conical bottom 34 are encouraged to migrate upwardly and radially outwardly along the bottom surface of conical bottom 34. The bubbles then do not collect on the bottom surface of the conical bottom 34. Such bubbles, if they remain in position, would permit overheating and oxidizing of the bottom of the combustion chamber 4. Prior constructions of combustion chambers have had flat bottoms, or recessed bottoms, which are easy and inexpensive to manufacture. However, flat bottom combustion chambers have been known to oxidize in relatively short order and have had to be replaced on a frequent basis. The inverted conical design of the bottom 34 of the applicant's design is a unique feature and greatly prolongs the life of the combustion chamber 4. Gas bubbles are discouraged by the inverted conical design from collecting on the bottom surface of the chamber bottom 34, and overheating and subsequent oxidation is minimized.

The construction of the "doughnut" formed by the sleeve 40, top plate 38, roof 39 and girdle 50, is shown in more detail in FIG. 4. The "doughnut" contains cooling fluid which cools the burner sleeve 40 and roof 39 of the top end of the combustion chamber 4. The cooling fluid also spills over the exterior surface of the upper walls of the combustion chamber 4, above liquid level 6. The design of the "doughnut" is a unique feature of the combustion chamber 4 of the invention. The vertical thermo-couple 44 is welded in place to roof 39 of the interior of the "doughnut" by welds 41. Likewise, the plurality of vertical stabilizer rods 42 (one is shown) are located in place between the underside of the top plate 38 by welds 43 and the top of the roof 39, and tangentially to the inside of the top interior walls of the combustion chamber 4 (see FIG. 5). The cooling water in-flow pipe 46, which has at the bottom an elbow 47, which directs in-flow cooling water tangentially into the interior of the hollow "doughnut", is welded to top plate 38 by welds 49. A clean-out plug 48, which is accessible to an operator from the top of the chamber 4, and enables the operator to clean accumulated debris from the "doughnut", is screwed by male threads into female threaded receptacle 49, which is welded to the periphery of a hole in the roof 39. Another unique feature of the design of the cooling water "doughnut" is that the girdle 50 can be raised or lowered relative to the upper edge of combustion chamber 4, and top plate 38. Thus the flow of cooling water down the outer sides of the upper walls of chamber 4 can be adjusted by raising or lowering the girdle 50 and thus the amount of cooling water that spills in water-fall fashion over lip 51.

Sleeve 40 replaces the sleeve which is normally found on a commercial burner. The burner 21, with its sleeve removed, fits on the sleeve 40 and is mounted in place by bolt 66. The cooling water being introduced into pipe and elbow 47 is indicated by arrow 72. The water being introduced into the interior of the "doughnut" at a tangent is indicated by arrow 74.

Figure 5:
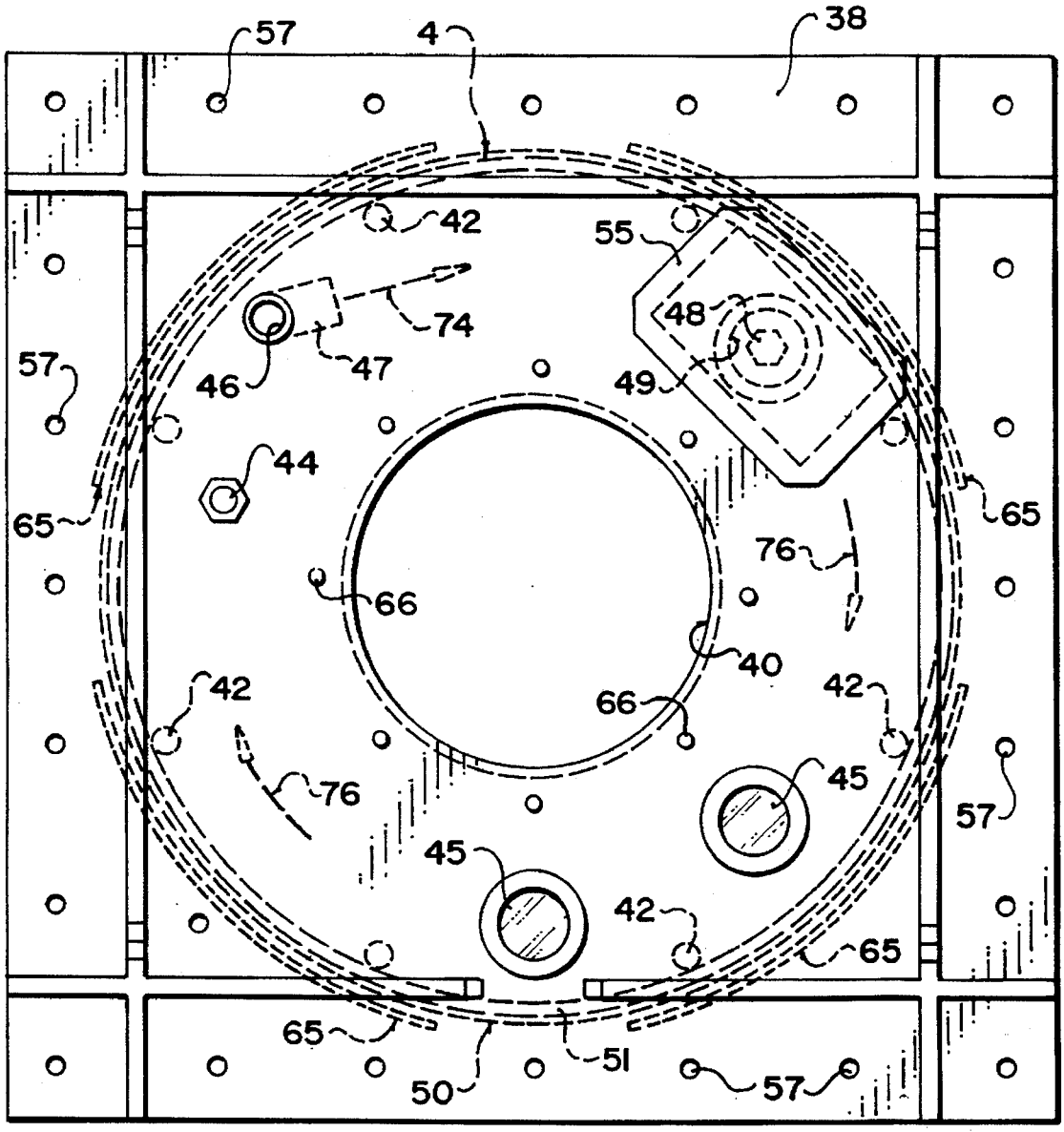
FIG. 5 illustrates a plan view of a combustion chamber.

FIG. 5 shows a top view of the combustion chamber 4 (shown in dotted lines) and the square steel top plate 38 which indirectly connects the top of the chamber 4 to the top 3 of the tank 2 (see FIGS. 1 to 4). The semi-tangential orientation of elbow 47 can be seen at the top left of the FIG. 5. Cooling water introduced through elbow 47 (indicated by arrow 74) is forced to swirl tangentially around the interior of the "doughnut" (indicated by arrows 76), thereby keeping the cooling water in constant circulation, and the sleeve 40 and roof 39 of the "doughnut" cool. The upper end of the burner sleeve 40 fits against the base of a standard nozzle mix burner which is located above the sleeve. A standard burner is available from Maxon Corporation Muncie, Ind. The cooling water spills over the lip 51 of the top of the girdle 50. A removable manhole-cover plate 55, which is constructed above the clean-out plug 48 and threaded coupling 49, is shown at the top right of FIG. 5. The top of thermocouple 44 is shown at the left of the "doughnut". The vertical and inclined "peep-sights" 45 are illustrated at the bottom of FIG. 5 and permit the operator to climb up on top 3 of the tank 2 and view the interior of the chamber 4 and the flame action in the interior of the combustion chamber 4.

FIG. 5 also illustrates in dotted line configuration the circumference of the combustion chamber 4, the exterior cylindrical girdle 50 of the "doughnut", which slides vertically upwardly or downwardly on combustion chamber 4 and segmental deflectors 65 (see also FIG. 6) which contain stray cooling liquid. A series of equally spaced support rods 42 are distributed around the interior of the periphery of the combustion chamber 4. The steel plate 38 is secured to the top of the tank 2 by a spaced array of bolts 69 (see FIG. 4) which pass through bolt holes 57.

Figure 6:
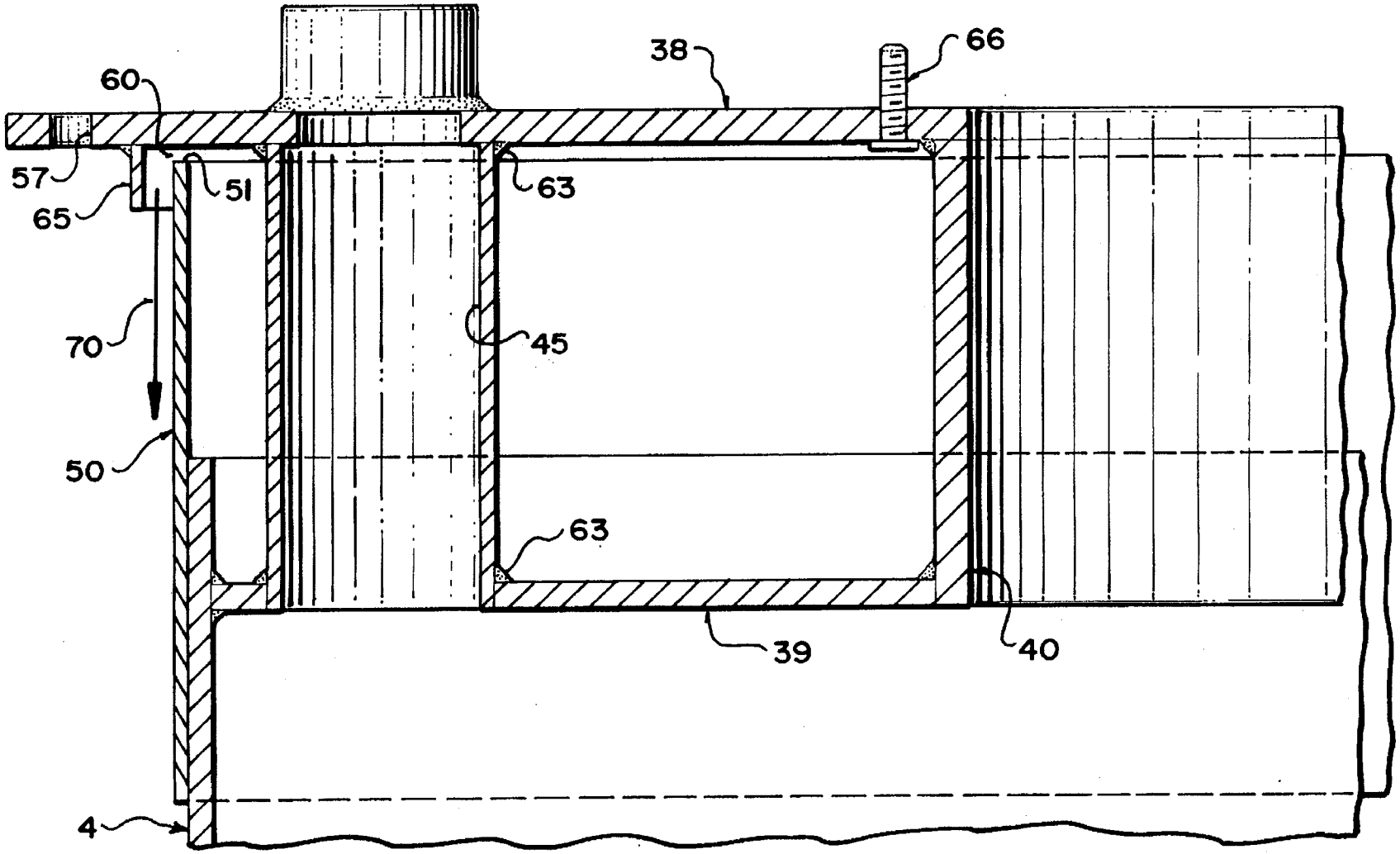
FIG. 6 illustrates a side section detail of a top corner of a combustion chamber.

FIG. 6 illustrates a cross-section detail of a top left portion of the combustion chamber 4 and the "doughnut". The cylindrical hollow "peep sight 45" is vertically positioned and penetrates through the interior of the "doughnut" and is held in place by welds 63. As can be seen in FIG. 6, there is a small opening 60 between the top plate 38 and the top lip 51 of the girdle 50 of the "doughnut". Once the girdle 50 of the "doughnut" has been adjusted to the proper elevation in association with the top edge of combustion chamber 4, and cooling water is introduced into and is circulated in the interior of the "doughnut", the cooling water spills over the top lip 51 of the girdle 50 through opening 60 and flows down the outer side walls of the upper region of the combustion chamber 4. This is indicated by arrow 70. This cooling liquid provides a cooling effect on the top regions of the combustion chamber 4, which are above the liquid level 6, when the submerged combustion system is in operation. The cooling liquid keeps the temperature of the combustion chamber 4 relatively uniform throughout its height, above the liquid level 6. An outer downwardly projecting segmented deflector 65, which is of a broken ring-like configuration (see FIG. 5), is welded to the underside of the top plate 38, and surrounds the opening 60. This deflector 65 induces the cooling fluid to travel downwardly and flow down the outside wall of the girdle 50 and the upper outer regions of the combustion chamber 4. If deflector 65 were not in place, some of the tangentially flowing cooling water would project or spray outwardly and therefore would not contact the outer surface of the combustion chamber 4. The cooling effect of some of the cooling liquid would be lost if all of the liquid did not contact the outer walls. Lip 51 should be leveled around its circumference so that opening 60 is uniform throughout and cooling water in turn is uniformly distributed over the exterior upper surface walls of combustion chamber 4.

Figure 7:
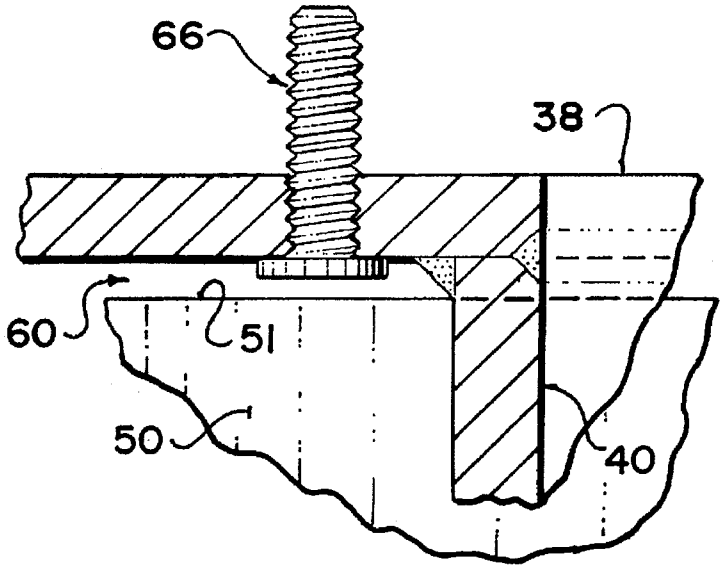
FIG. 7 illustrates an enlarged side view of the top left region of FIG. 4.

FIG. 7 illustrates a section detail of the top left part of FIG. 4 and illustrates the way in which the top region of the inner wall of the burner sleeve 40 is welded to the top plate 38 of the combustion chamber. A portion of the water gap 60 is also visible in detail shown in FIG. 7. Mounting bolt 66 for mounting the burner (not shown) in place on sleeve 40 is also shown in section.

Figure 8:
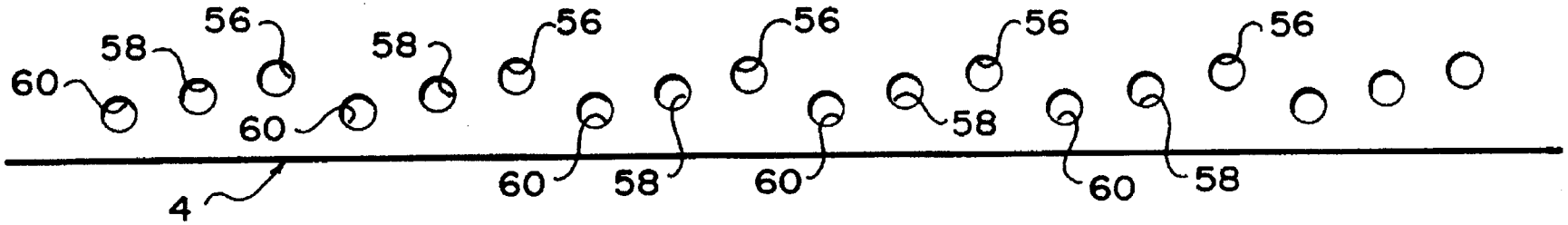
FIG. 8 illustrates an enlarged side view of the gas exit ports at the bottom region of a combustion chamber.

FIG. 8 illustrates a detailed view of a preferred embodiment of the combustion products outlet ports at the bottom region of the combustion burner 4, depicted generally by reference numeral 36, in FIG. 2. It will be noted in FIG. 8 that the exit ports are circular in construction and are positioned in horizontal series at three different elevations in the bottom region of the side walls of the combustion tank 4. The series of upper ports 56 are at the same elevation, the series of mid-ports 58 are at a lower elevation, and the series of lower ports 60 are at lowest elevation. The centers of radius of the first level of ports 56 intersect with the tops of the second level of ports 58. Likewise, the centers of radius of the second level of ports 56 intersect with the tops of the third level of ports 60.

During start-up of the submerged combustion system, when the liquid level 6 is at a static "rest" elevation, the liquid is in the interior of the combustion chamber 4, as well as in the tank 2. When the combustion chamber 4 is first purged by air from the air line 22, as required by safety regulations, the liquid level inside the chamber 4 is forced to drop to completely clear the combustion chamber 4 of liquid. The liquid 6 is forced through the ports 56, 58 and 60.

During dynamic operation, the total area of the ports 56, 68 and 60 must be sufficient to permit maximum velocities of combustion gas to escape through the ports 56, 58 and 60. These velocities can be as high as 50,000 feet/min. However, in many situations, the combustion system may be "turned down", that is, the rate of gas-air burning may be reduced to as low as 1:3 and the generation of combustion gases may be proportionally reduced so that the velocities are as low as 15,000 feet/min. through the ports. The ports design must be capable of handling this wide variation in combustion gas velocities through the ports without creating problems with gaseous eruptions, vibration, backflow of liquid through some of the ports into the interior of the chamber 4 due to the substantial head of the liquid in the tank 2, and other problems. It is also helpful if wide variations in gas flow through the ports can be handled without any moving parts.

The ports must also be sufficiently numerous and small that they disperse the combustion gas horizontally into the liquid at different levels in millions of gas bubbles with maximum surface (heat exchange) area, maximum liquid mixing and circulation action with no cold zones, minimum bubble coalescence which reduces heat exchange efficiency, and minimum liquid surface level 6 disturbance since waves and splashing reduce efficiency.

Through a long process of trial and error, we have discovered that multiple levels of small ports provide not only the flexibility to accommodate wide variations in combustion gas flow velocities but also generate millions of small gas bubbles which are emitted at multiple levels to maximize circulation in the liquid 6 and exchange of heat from the gas bubbles into the liquid, and minimize turbulence at the surface of the liquid.

In evaluating different port configurations, and particularly one level of ports, it was found that the combustion gases tended to surge in bursts through a single elevation of ports. These surges caused an undesirable "rumbling" or vibration action, and excessive creation of bubbles, which create an undesirable turbulence at the top of the liquid in the tank 2 outside the chamber 4. The inventors have discovered by considerable experimentation that a series of small ports of two or three different elevations effectively deals with this problem. Apparently, with a large number of ports at different levels, and notwithstanding wide variations in gas flow velocity, the combustion gases are able to readily cope with the head of the liquid outside the chamber 4 and select an appropriate number and level of ports and escape smoothly through the ports into the tank 2 without creating surges and eruptions. The sizable head of liquid 6 is constantly attempting to force the liquid 6 to back flow into the chamber 4, and the flow of combustion gas through the ports must be sufficient to prevent this. The ports may be circular, oblong or any other suitable shape. The size and total area of the ports must be sufficient to readily accommodate a wide range in volume and velocity of hot gaseous combustion product that is generated in the combustion chamber 4. The multi-level ports 56, 58 and 60 do not include any moving parts and are another novel and inventive feature of this invention.

One of the functions of the three elevations of ports 56, 58 and 60 is to equalize port area at each specific level. The dimensions of the bottom halves of the top row of circular ports 56 diminish in a downwardly direction. This diminishing dimension of the bottom halves of the top ports 56 is accommodated by a corresponding increase in dimension of the top halves of the second row of ports 58, which are aligned at a second level. Likewise, the diminishing dimension of the lower halves of the second row of ports 58 is counteracted by the increasing dimension of the top halves of the lowest row of ports 60.

The tendency of the combustion gas in dealing with the head of liquid outside the combustion chamber 4 is to seek the path of least resistance, which is less head. The gaseous products of combustion thus tend to be first expelled through the top portions of the top series of ports 56. Hot gas bubbles then are forced from the interior of the combustion chamber 4 through the ports 56 into the liquid 6 in the tank 2 and rise to the surface of the liquid in the interior of the tank 2. If the volume of gas to be expelled through the top elevations of ports 56 is greater than can be accommodated by the sum of the areas of the upper level ports 56, then some of the combustion gas will tend to be expelled through the second level of ports 58 because this provides a greater total area through which the gas bubbles of the combustion products can be expelled from the interior of the combustion chamber 4 into the liquid in the interior of the tank 2. If the total area of the combination of the top elevation ports 56 and the mid-level ports 58 is not sufficient to handle the outflow volume of hot gaseous combustion products, then some of the combustion gases will be expelled through the lowest level of ports 60.

The inventors have found by conducting a large number of tests that the triple elevation series of ports 56, 58 and 60 eliminate the gas gurgitation or surging action, or at least minimize it, and provide an ideal solution to the gas "rumbling" or gurgitation problem. Furthermore, the combination of three separate sets of ports 56, 58 and 60 at three different elevations does not require any moving parts, such as might be required if valves, or moveable plates which adjust the area of opening of the ports, were installed. Thus, a trouble-free unique solution to accommodating a wide variation in gas flow velocity, is achieved. Also, the large number of ports at different levels generate millions of desirable small bubbles and maximize mixing action.

The size of the ports 56, 58 and 60 is important as well. The sum of the total area of the ports must obviously be large enough to handle the highest volume of hot combustion gases that are being generated in the interior of the chamber 4 and being expelled into the liquid in the tank 2. The size of the ports should be as small as possible to generate small bubbles, while the number of ports should be relatively large in order to maximize dispersion and minimize the generation of large bubbles which create undesirable high turbulence at the top of the liquid level 6 in the tank 2 and interferes with efficient heat transfer and efficient exhaust of the gas.

Figures 9, 10, 11, 12:
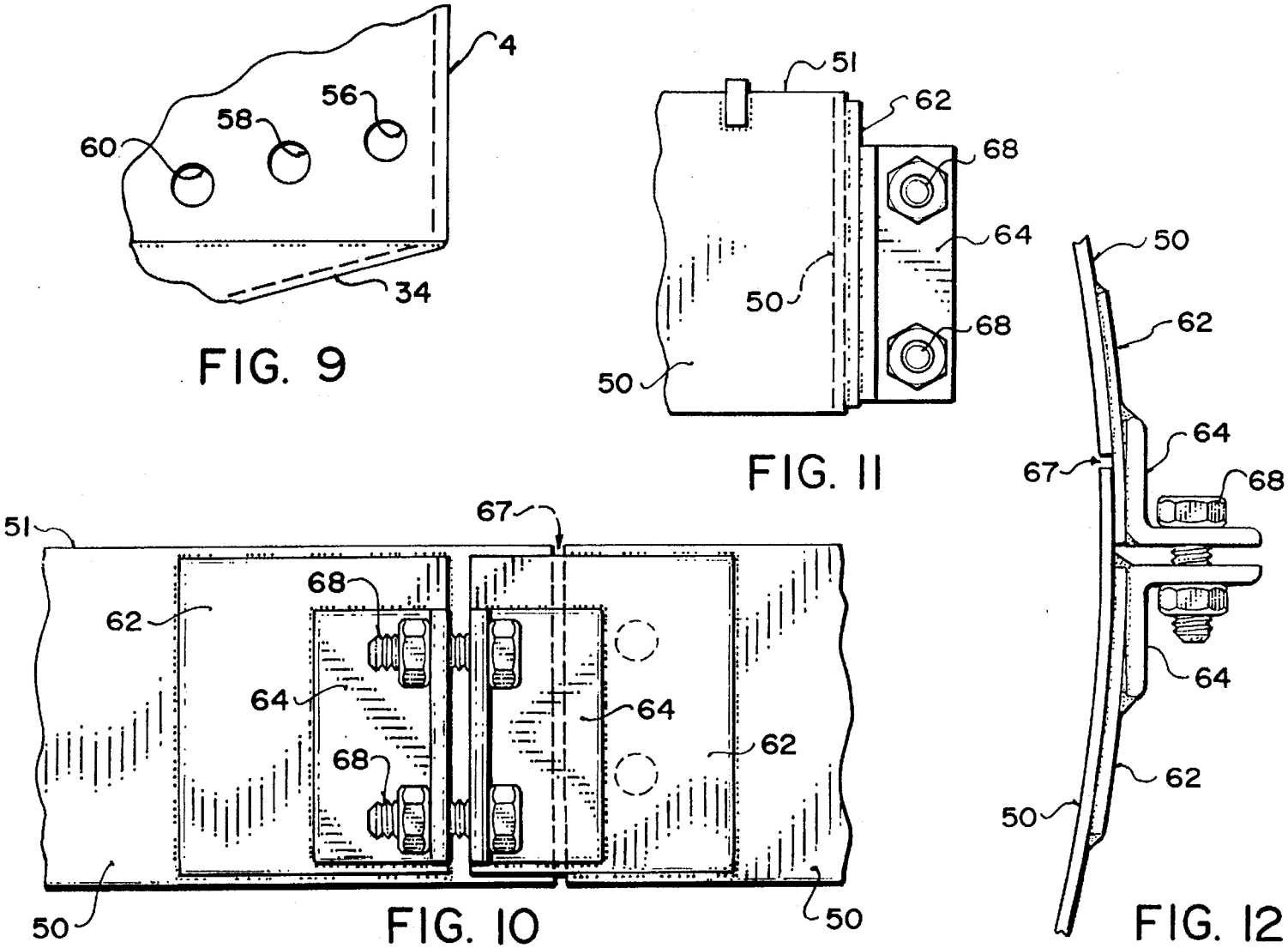
FIG. 9 illustrates a side detail of three elevations of gas exit ports in the bottom region of a combustion chamber.
FIG. 10 illustrates a side detail of a girdle for the top portion of a combustion chamber.
FIG. 11 illustrates a side view of a connection joint of a girdle for the top portion of a combustion chamber.
FIG. 12 illustrates a top view of a girdle and connection joint for the top portion of a combustion chamber.

FIG. 9 illustrates a detailed view of one set of ports 56, 58 and 60, at three different elevations, positioned immediately above the inverted conical bottom 34. As seen in detail in FIG. 9, the angle of the conical bottom with the horizontal is approximately 14°. This angle has been found to be of an appropriate incline to ensure that bubbles are encouraged to migrate radially and outwardly along the bottom of the inverted conical plate 34, and not collect and thereby cause overheating and destruction of the bottom of the combustion chamber 4.

FIGS. 10, 11 and 12 illustrate the securing mechanism that is used to hold the outer cylindrical girdle 50 of the "doughnut", at any particular specified elevation, to adjust flow of the cooling water. The outer reinforcing bands 62 are welded to the girdle 50 and angle irons 64, which are pulled together by bolts 66. This structure enables the girdle 50 to be tightened by means of bolt 66 so that the gap 67 becomes very small. The elevation of cylindrical girdle 50 can be adjusted relative to the top plate 38 in order to adjust the opening of gap 60, and in turn the flow of cooling water down the exterior walls of the combustion chamber 4.

Figure 13:
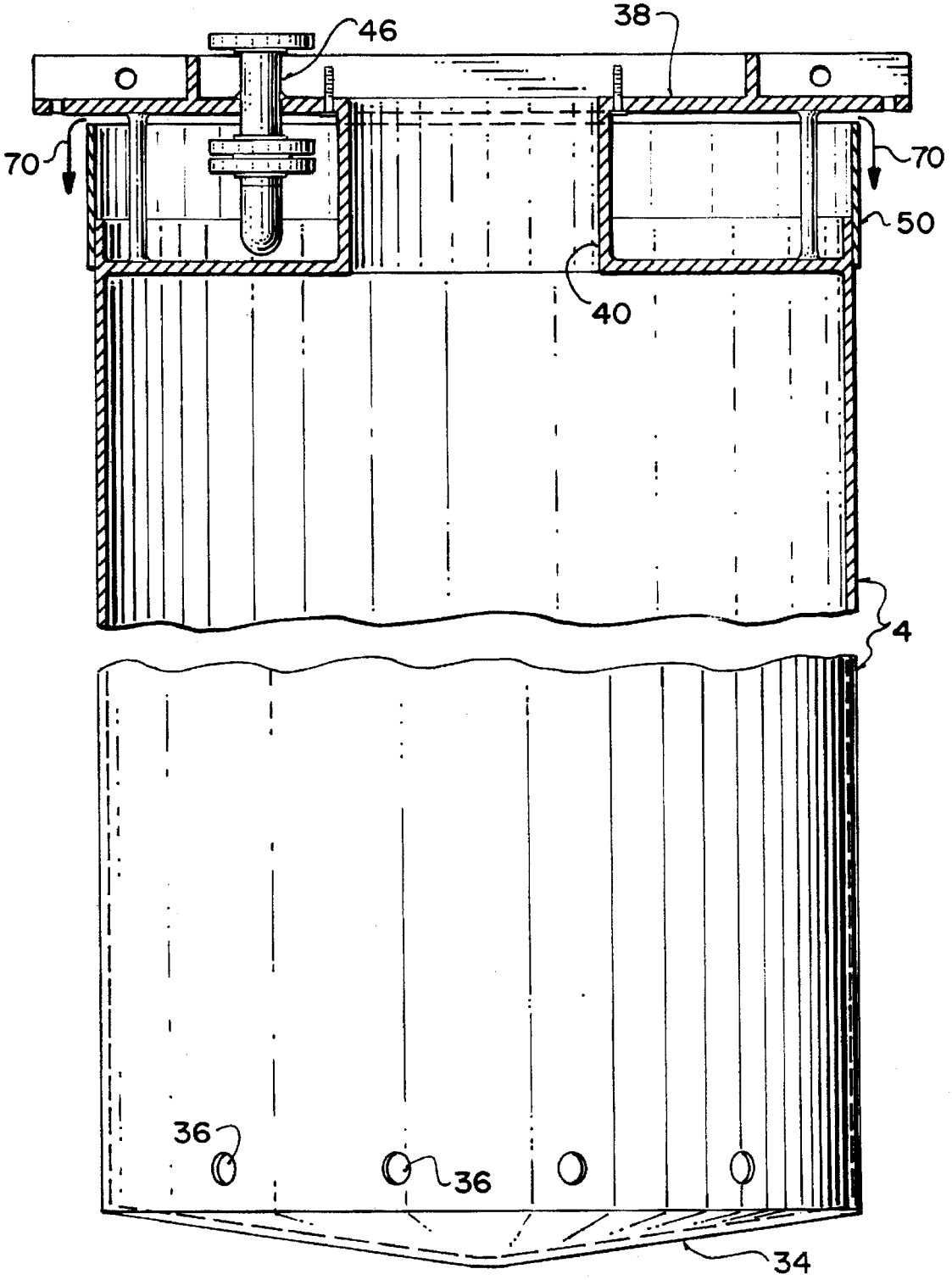
FIG. 13 illustrates a truncated side view of the top and bottom of an alternative embodiment of combustion chamber.
Figure 14:
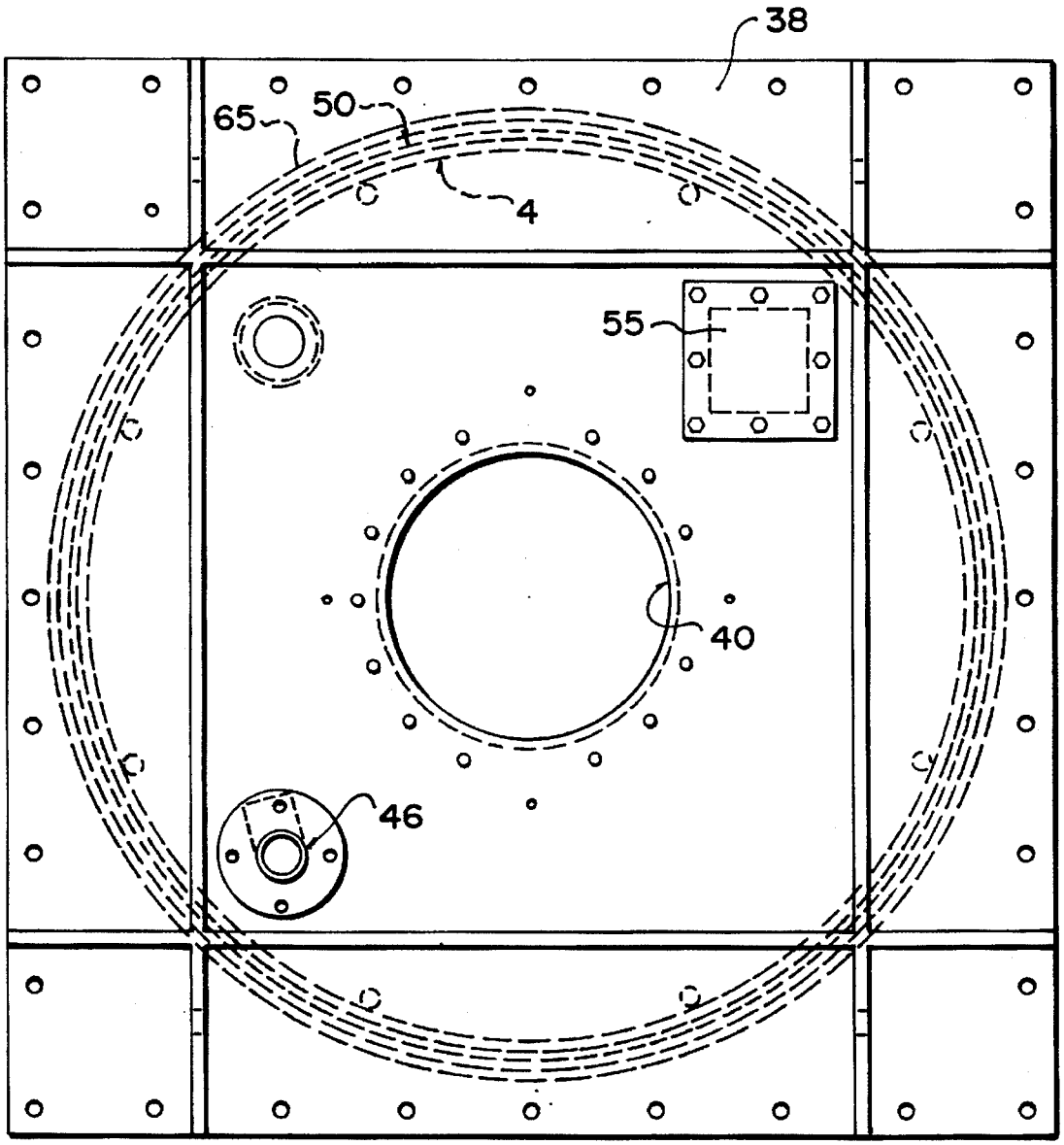
FIG. 14 illustrates a plan view of an alternative embodiment of combustion chamber.

FIG. 13 illustrates a truncated side section view of the top and bottom of an alternative embodiment of combustion chamber. FIG. 14 illustrates a plan view of the alternative embodiment of the combustion chamber. The embodiment of combustion chamber illustrated in FIGS. 13 and 14 is simpler in construction than the embodiment disclosed in the previous drawings. The base of the combustion chamber 4 has two elevations of ports 36, rather than three elevations. Also, the construction of the "doughnut" for the cooling water system is simplified. However, the basic function of cooling the upper outer walls of the combustion chamber 4 is the same. Water for cooling spills over the upper lip of the cylindrical outer girdle 50.

Advantages of the Submerged Combustion System

The submerged combustion system has a large number of advantages over other liquid heating systems. (1) Over 90% efficiency. (2) Uniform temperatures throughout the solution in the tank due to strong solution agitation. (3) Compact design solution holding tank, depending on solution type, permits combustion tank to act as a reaction vessel, due to the strong mixing action developed. (4) The combustion tank is not pressurized and is designed so that maintenance personnel can easily enter tank and perform maintenance tasks. (5) Operation of the submerged combustion system does not require a Certified Operating Engineer. (6) Solution discharge temperature is controlled with a single feedback loop, so that expensive and troublesome controls and valves are not required. (7) Simple, safe, and reliable design provides years of trouble free service.

The submerged combustion system can be available as a standardized pre-packaged unit with heat inputs up to 20-million Btu per hour. The system capacity selected determines whether single or multiple burner units are required. Generally, single burner units are sufficient up to 10-million Btu per hour, whereas multiple burner units are required for systems generating more than 10-million Btu per hour. Field erection is required for units over 20-million Btu per hour.

The burner design selected should provide complete and efficient mixing of the fuel and combustion air. In larger applications, multiple burners can be readily installed at the top of the tank. The combustion chamber should be sized relative to the tank dimensions to ensure that relatively high velocities are obtained for proper unit operation. The submerged combustion system should be controlled with Programmable Logic Control (PLC) based flame safeguard systems. The totally automatic control system enables the system to be started with a simple "Start" button.

Submerged Combustion Operation

During system start-up, a five-second automatic pre-ignition purge evacuates liquid from the combustion chamber. The PLC-based burner management system supervises and controls all interlocks and upon proof of pilot ignition, permits main burner ignition. During operation, the heat input is controlled by sensing the temperature of the liquid at the point of discharge. The liquid level in the tank is constantly monitored and interlocked by means of an air bubble liquid level sensing system.

In an alternative grid system, the tanks 2 can be excluded and the grid array of combustion chambers 4 and tanks can be partially submerged directly into the solution to be heated. In that case, the hot combustion gases are expelled from the bottom ports 36 in the combustion chambers 4 into the solution in the tanks 2 and are exhausted through outlets 30. The heated solution is pumped from the tanks, while cold solution is returned to the pond and into the tanks.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. In a submerged combustion system wherein hot gaseous products of combustion are forced through a liquid solution to heat the solution, the hot gaseous combustion products being created by burning a fuel with air in the interior of a hollow fuel-air retaining means a base portion of which is submerged in the liquid solution, and the hot gaseous products of combustion being exhausted from the interior of the retaining means into the liquid solution below the surface of the liquid solution, the improvement comprising exhausting the hot gaseous products of combustion through (a) a plurality of first ports disposed at a first elevation around the perimeter of the walls of the base of the retaining means below the level of the solution, (b) a plurality of second ports disposed at a second elevation around the perimeter of the walls of the base of the retaining means below the first elevation with the elevations of the tops of the plurality of second ports intersecting with the elevations of the bottoms of the plurality of first ports;

(c) a plurality of third ports disposed at a third elevation around the perimeter of the walls of the base of the retaining means below the second elevation with the elevations of the tops of the plurality of third ports intersecting with the elevations of the bottoms of the plurality of second ports, the size of the plurality of ports being predetermined to minimize turbulence in the solution and foam being created at the surface of the solution, wherein said plurality of first ports, said plurality of second ports and said plurality of third ports are circular and vertically offset from one another, the centres of radius of the plurality of first ports intersecting with the tops of the plurality of second ports, the centres of radius of the plurality of second ports intersecting with the tops of the plurality of first ports, and the centres of radius of the plurality of third ports intersecting with the tops of the plurality of second ports.

2. A combustion system as claimed in claim 1 wherein the base of the combustion chamber is in the shape of an inverted cone.

* * * * *